US010196853B2

(12) United States Patent
Bertovic

(10) Patent No.: US 10,196,853 B2
(45) Date of Patent: Feb. 5, 2019

(54) DOOR AND METHOD OF FORMING A DOOR

(71) Applicant: INTER-JOIN PTY/LTD., Abbotsbury, New South Wales (AU)

(72) Inventor: Tomo Zvonko Bertovic, Abbotsbury (AU)

(73) Assignee: INTER-JOIN PTY/LTD., Abbostbury, NSW (AU)

( * ) Notice: Subject to any disclaimer, the term of this patent is extended or adjusted under 35 U.S.C. 154(b) by 0 days.

(21) Appl. No.: 14/898,125

(22) PCT Filed: Jun. 14, 2014

(86) PCT No.: PCT/AU2014/000623
§ 371 (c)(1),
(2) Date: Dec. 12, 2015

(87) PCT Pub. No.: WO2014/197945
PCT Pub. Date: Dec. 18, 2014

(65) Prior Publication Data

US 2016/0145935 A1 May 26, 2016

(30) Foreign Application Priority Data

Jun. 14, 2013 (AU) ..... 2013100831

(51) Int. Cl.
*E06B 5/16* (2006.01)
*E06B 3/70* (2006.01)
(Continued)

(52) U.S. Cl.
CPC ..... *E06B 5/16* (2013.01); *E05D 3/02* (2013.01); *E06B 3/30* (2013.01); *E06B 3/34* (2013.01);
(Continued)

(58) Field of Classification Search
CPC .... E06B 5/16; E06B 2003/7086; E06B 3/827; E06B 3/7015; E06B 3/7001; E06B 3/34; E06B 3/30; E06B 2003/7049; E06B 2003/7023; E06B 2003/7042; E05B 3/02
USPC ..... 52/309.1, 309.4, 309.14, 783.1, 783.11, 52/783.12, 784.1, 784.11, 784.12, 784.13, 52/784.15, 784.16, 795.1, 797.1
See application file for complete search history.

(56) References Cited

U.S. PATENT DOCUMENTS 3,786,613 A * 1/1974 Shepheard ..... E06B 3/827 52/309.9
4,819,383 A * 4/1989 McKann ..... E06B 3/827 49/501
4,888,918 A * 12/1989 Green ..... E06B 5/16 49/501
(Continued)

FOREIGN PATENT DOCUMENTS

DE 102004033298 A1 2/2006
JP 2001 205995 A 7/2001
(Continued)

*Primary Examiner* — Theodore V Adamos
(74) *Attorney, Agent, or Firm* — Craft Chu PLLC; Andrew W. Chu

(57) ABSTRACT

A door includes a single panel folded to form a latch face and first and second main faces of the door. The door preferably further includes edge tabs folded to form upper, lower and hinge faces of the door. The panel is preferably a composite panel including an inner metal sheet, an outer metal sheet, and a plastics core material between the metal sheets.

15 Claims, 20 Drawing Sheets

(51) Int. Cl.

| | |
|---|---|
| ***E06B 3/82*** | (2006.01) |
| ***E06B 3/30*** | (2006.01) |
| ***E06B 3/34*** | (2006.01) |
| ***E05D 3/02*** | (2006.01) |

(52) U.S. Cl.
CPC ..... *E06B 3/7001* (2013.01); *E06B 3/7015* (2013.01); *E06B 3/827* (2013.01); *E06B 2003/7023* (2013.01); *E06B 2003/7042* (2013.01); *E06B 2003/7049* (2013.01)

(56) References Cited

U.S. PATENT DOCUMENTS 5,018,263 A * 5/1991 Stern ..... B21D 35/00 160/371
5,918,644 A * 7/1999 Haack ..... F16L 9/003 138/146
6,389,769 B1 * 5/2002 McKinney ..... E06B 3/822 156/78
6,952,903 B2 * 10/2005 West ..... B29C 43/003 52/309.9
2002/0108337 A1 * 8/2002 Clarke ..... E05D 5/023 52/309.9
2008/0251183 A1 * 10/2008 Turner ..... B29C 44/1233 156/79
2010/0024309 A1 * 2/2010 Tavarez ..... E06B 3/76 49/501
2010/0263314 A1 * 10/2010 MacDonald ..... E04F 13/0826 52/506.05
2012/0198788 A1 * 8/2012 MacDonald ..... E04F 13/0825 52/747.1

FOREIGN PATENT DOCUMENTS

JP 2009 270341 A 11/2009
WO 2009 009207 A2 1/2009

* cited by examiner

DOOR AND METHOD OF FORMING A DOOR

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a door and method of forming a door.

2. Description of Related Art Including Information Disclosed Under 37 CFR 1.97 and 37 CFR 1.98

Door construction has remained the same for many years, being a timber or Medium Density Fibreboard (MDF) frame, with a honey comb insert material that is covered with a timber veneer or MDF panel suitable for staining or painting. In recent years, pre-finished material has been used for door surfaces. However, by way of construction, the door ends are exposed in the raw state that require painting.

By way of installation, all doors have only three visible surfaces, being an internal main face of the door (facing an inside of the room), an external main face (facing an outside of the room) and the latched side face. The top face, bottom face and hinged face of the door are not readily visible on an installed door.

The present invention seeks to overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

BRIEF SUMMARY OF THE INVENTION

According to a first aspect, the present invention provides a door comprising a single panel folded to form a latch face and first and second main faces of the door.

In a preferred embodiment, the panel further comprises edge tabs folded to form upper, lower and hinge faces of the door.

In another preferred embodiment, the panel is substantially rigid and comprises two parallel grooves formed into an inner surface thereof, the grooves being spaced by a distance equal to the width of the latch face and wherein sections of the panel at opposing sides of the latch face form the main faces of the door.

In another preferred embodiment, the panel comprises additional grooves formed in the inner surface along lines parallel to and inwardly spaced from edges of the panel to form side, upper and lower edge tabs which are folded towards each other to form the hinge, upper and lower faces of the door respectively.

In another preferred embodiment, the latch face comprises upper and lower triangular tabs, and the upper and lower tabs of the main sections are cut at an angle such that adjacent edge tabs are substantially contiguous when folded.

In another preferred embodiment, the panel is a composite panel comprising an inner metal sheet, an outer metal sheet, and a plastics core material between the metal sheets.

In another preferred embodiment, the core material is a thermosetting plastics which substantially does not melt when heated.

In another preferred embodiment, the door further comprises infill material disposed within the folded panel.

In another preferred embodiment, the door further comprises a frame disposed within the folded panel.

In another preferred embodiment, the infill material is fireproof material.

In another preferred embodiment, the infill material is inserted into the door in liquid form that expands and solidifies as foam.

In another preferred embodiment, the infill material is liquid polyurethane or polyethylene that sets solid.

In another preferred embodiment, the door further comprises at least one hinge, the hinge comprising a door mount section attached to the side tabs forming the hinge face.

In another preferred embodiment, the panel is a flexible wrap.

In another preferred embodiment, the panel is a metal or plastics sheet or a combination thereof.

In another aspect, the present invention provides a method of forming a door using a single panel, the method comprising folding the panel to form a latch face and first and second main faces of the door.

In another aspect, the present invention provides a method of forming a door, the method comprising

- forming two parallel grooves into an inner surface of a panel, the grooves being spaced by a distance equal to the width of a latch face of the door to be formed, and
- folding the panel to form a latch face and first and second main faces of the door.

In a preferred embodiment, the panel is a composite panel comprising an inner metal sheet, an outer metal sheet with a plastics core material therebetween, the forming step comprising cutting the groove into the inner metal sheet and partly into the core material.

In another preferred embodiment, the method further comprises:

- forming additional grooves in the inner metal sheet along lines parallel to and inwardly spaced from edges of the panel to form side, upper and lower edge tabs, and
- folding the adjacent side, upper and lower edge tabs towards each other to form the hinge, upper and lower faces of the door respectively.

In another preferred embodiment, the method further comprises:

forming upper and lower triangular tabs in the latch section and cutting an angle in the upper and lower tabs of the main section such that the adjacent edge tabs are substantially contiguous when folded.

In another preferred embodiment, the method further comprises inserting a frame into the folded panel.

In another preferred embodiment, the method further comprises inserting an infill material into the folded panel, the infill material being inserted into the door in liquid form and expanding and solidifying as foam within the door.

In another preferred embodiment, the method further comprises mounting at least one hinge to the door, the hinge comprising a door mount section which is attached to the side tabs.

In another aspect, the present invention provides a method of forming a composite panel, the method comprising providing an inner metal sheet, an outer metal sheet, and a thermosetting plastics core material, partially curing the thermosetting plastics core material so as to be pliable and forming the plastics core material into a sheet;

mounting the inner metal sheet and the outer metal sheet to opposing side faces of the plastics core material sheet.

In a preferred embodiment, the method further comprises further curing of the thermosetting plastics core material to harden the thermosetting plastics core material.

In another preferred embodiment, the method further comprises the intermediate step of folding the partially cured thermosetting plastic core material and the inner and outer sheets into a required shape prior to the further curing step.

In another preferred embodiment, the further curing step is performed by at least one of heat, radiation or a combination thereof.

In another preferred embodiment, the metal sheets are aluminium.

In another aspect, the present invention provides a door comprising a single panel folded to form a hinge face and first and second main faces of the door.

In a preferred embodiment, the panel further comprises edge tabs folded to form upper, lower and latch faces of the door.

In another preferred embodiment, the latch face comprises a double rebate.

In another preferred embodiment, the panel is substantially rigid and comprises two parallel grooves formed into an inner surface thereof, the grooves being spaced by a distance equal to the width of the hinge face and wherein sections of the panel at opposing sides of the hinge face form the main faces of the door.

In another preferred embodiment, the panel comprises additional grooves formed in the inner surface along lines parallel to and inwardly spaced from edges of the panel to form side, upper and lower edge tabs which are folded towards each other to form the hinge, upper and lower faces of the door respectively.

In another preferred embodiment, one of the main faces is wider than the other, the wider main face comprising two adjacent edge tabs.

Other aspects of the invention are also disclosed.

BRIEF DESCRIPTION OF THE SEVERAL VIEWS OF THE DRAWINGS

Notwithstanding any other forms which may fall within the scope of the present invention, preferred embodiments of the present invention will now be described, by way of examples only, with reference to the accompanying drawings.

DETAILED DESCRIPTION OF THE INVENTION

Figure 1:
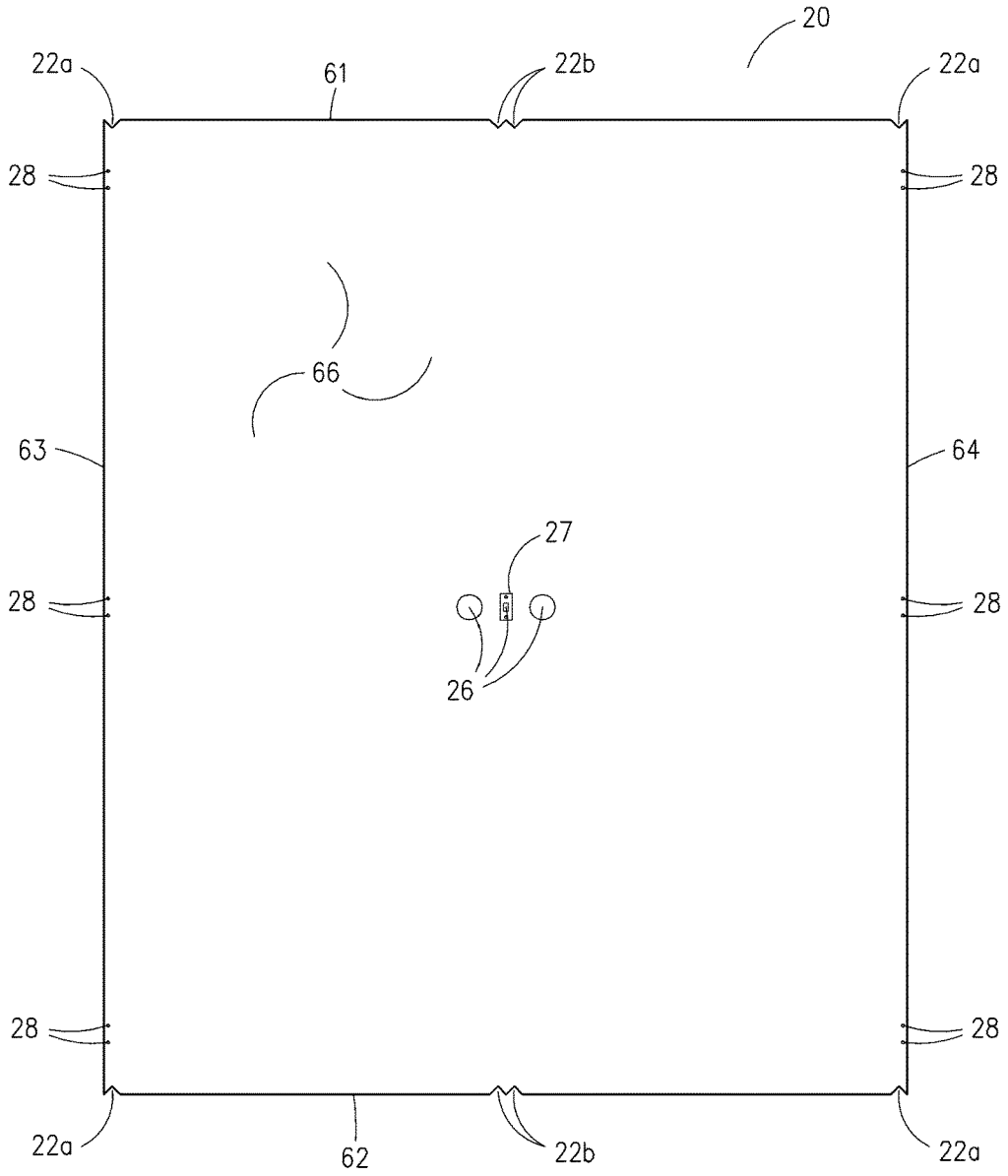
FIG. 1 is a front elevation view of an external surface of an unfolded panel for a door according to a preferred embodiment of the present invention.

It should be noted in the following description that like or the same reference numerals in different embodiments denote the same or similar features.

FIG. 1 shows a substantially rigid panel 20 for a door 100 according to a preferred embodiment of the present invention.

Figure 2:
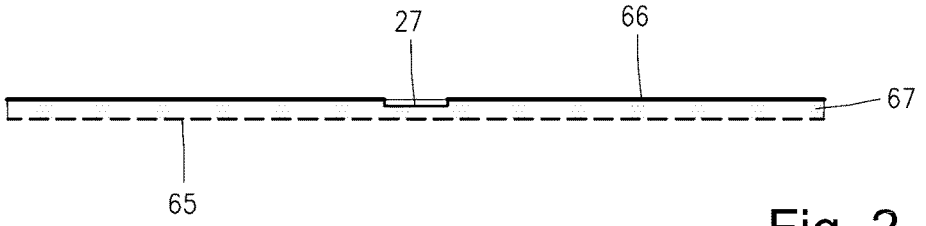
FIG. 2 is a cross-sectional view across a mid-portion of the panel of FIG. 1.

The panel 20 comprises an upper edge 61, a lower edge 62, a first side edge 63 and a second side edge 64. As shown in FIG. 2, the panel 20 is made from an aluminium composite comprising an inner aluminium sheet 65, an outer aluminium sheet 66 with a plastics core material 67 therebetween.

Figure 3:
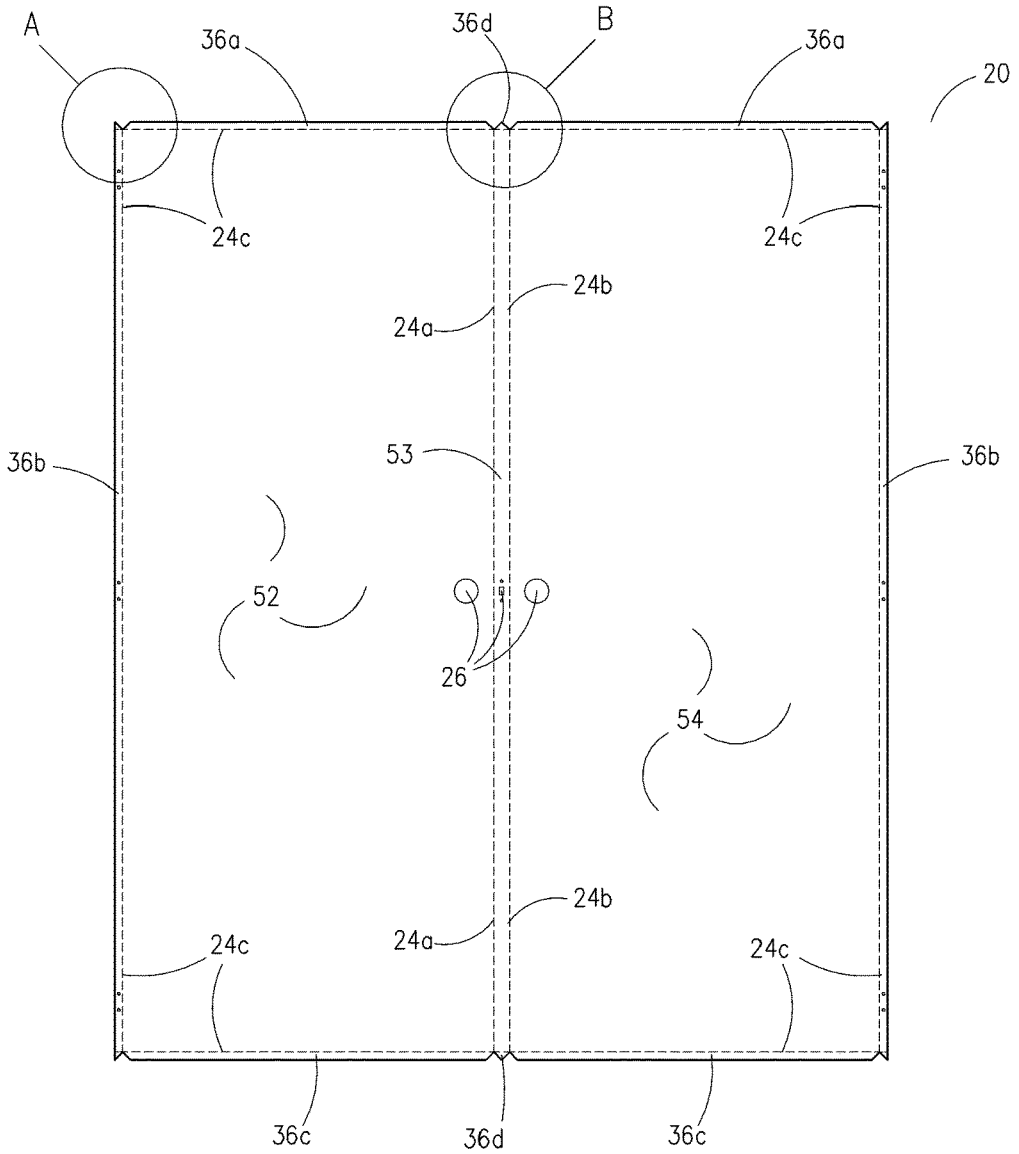
FIG. 3 is a front elevation view of an internal surface of the unfolded panel of FIG. 1 showing cut and fold lines.
Figure 4:
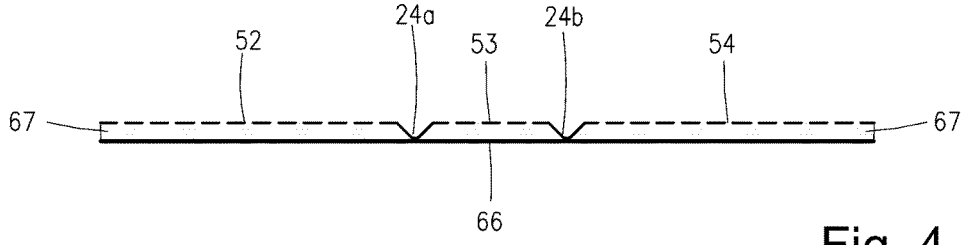
FIG. 4 is a cross-sectional view of a central portion of the panel of FIG. 3.

As shown in FIGS. 3 and 4, two parallel V-shaped grooves 24*a* and 24*b* are cut into the inner sheet 65 and partly into the core 67 at a mid-portion of the panel 20, the grooves 24*a* and 24*b* extending substantially from the upper edge 61 to substantially the lower edge 62 as shown in FIG. 3. The outer sheet 66 is unmarked.

Figure 5:
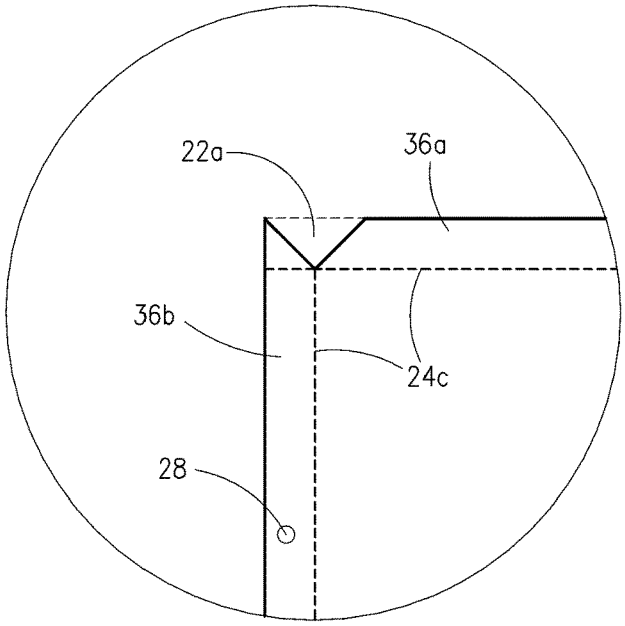
FIG. 5 is an enlarged front elevation view of detail A of FIG. 3 showing the upper left panel corner portion at the hinge face of the door.

Additional V-shaped grooves 24*c* are cut into the inner sheet 65 and partly into the core 67 along lines parallel to and inwardly spaced from the edges 61 to 64, forming edge tabs 36. As shown in FIG. 5, triangular corner portions 22*a* of the panel 20 are cut out, the triangle 22*a* having its apex aligned with the vertical groove 24*c*.

Figure 6:
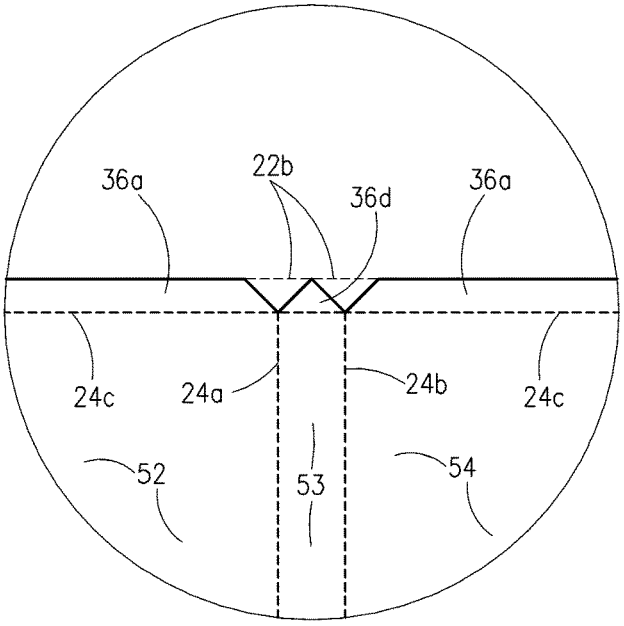
FIG. 6 is an enlarged front elevation view of detail B of FIG. 3 showing the middle section of the upper edge of the panel.
Figure 7:
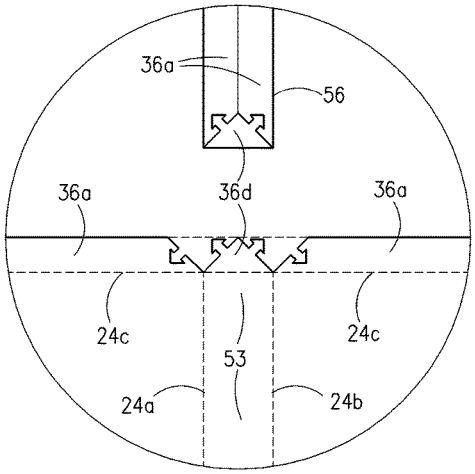
FIGS. 7 to 10 show isolated front elevation views of alternative shape cuts to that shown in FIG. 6.
Figure 8:
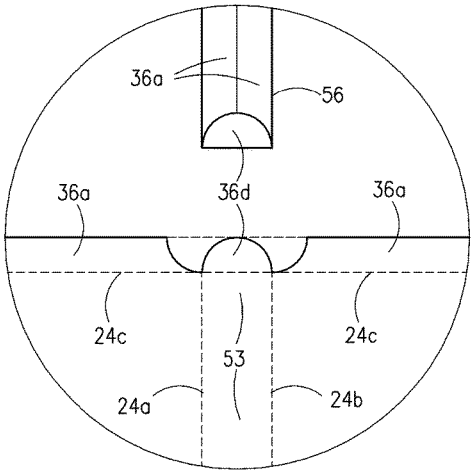
Figure 9:
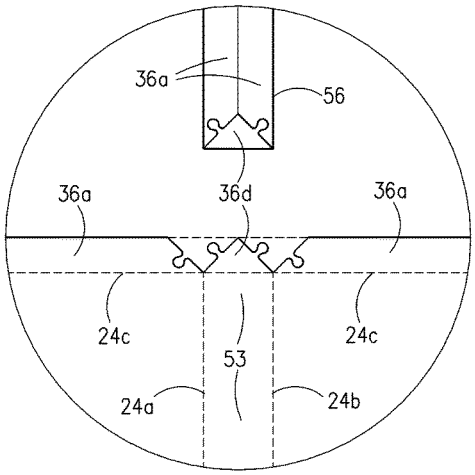
Figure 10:
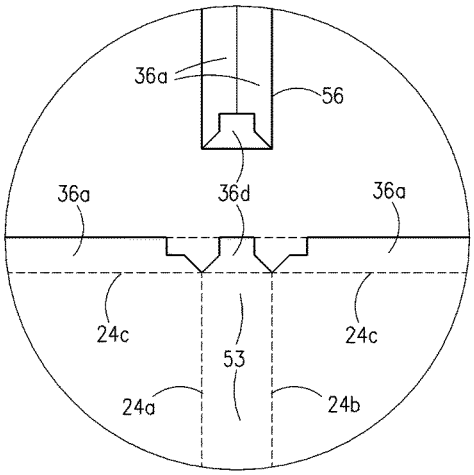

As shown in FIG. 6, two triangular portions 22*b* are cut out from the panel 20 at the upper and lower edge tabs, each respective triangular portions 22*b* extending from an upper/lower edge 61/62 and terminating at the intersection between the grooves 24*c* and 24*a*/24*b*.

The grooves 24*a* and 24*b* divide the panel 20 into a first main section 52, a second main section 54 and a latch section 53. The latch section 53 is formed between the grooves 24*a* and 24*b* and the latch section 53 is dimensioned to have a width corresponding to the thickness of the door 100 in use (i.e. the distance between the grooves 24*a* and 24*b* corresponds to the door thickness). The first and second main sections 52 and 54 are disposed on opposing sides of the latch section 53. Both the first and second main sections 52 and 54 are generally rectangular and dimensioned to substantially cover the intended doorway. The first and second main sections 52 and 54 extend from a respective one of the grooves 24*a* and 24*b* to the perimeter grooves 24*c*. The external surfaces of the main sections 52 and 54 in use will define the internal and external main faces of the door 100.

The cutout portions 22*a* form upper tabs 36*a*, side tabs 36*b*, and lower tabs 36*c*. The cutout portions 22*b* form triangular upper tabs 36*d* at the upper and lower ends of the latch section 53.

The panel 20 comprises spaced pairs of hinge mount apertures 28 formed adjacent the side edges 63 and 64, the apertures 28 being disposed in the side tabs 36*b*. The panel 20 further comprises closely spaced latch mount apertures 26 formed at a mid-section of the panel 20, with two rounded apertures 26 formed in the main sections 52 and 54 and a rectangular aperture 26 formed in the latch section 53. A latch plate 27 is mounted to the outer sheet 66 aligned with the aperture 26 in the latch section 53. The latch plate can be recessed in the panel 20 as shown in FIG. 2.

Figure 11:
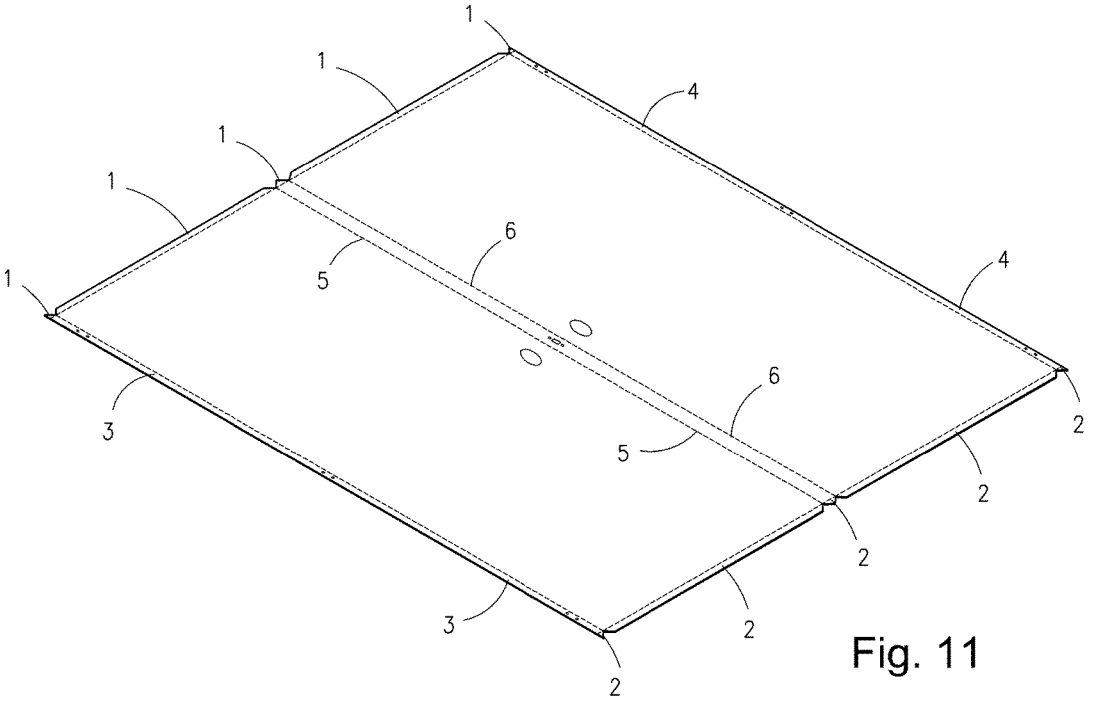
FIG. 11 is an isometric or perspective view of the unfolded panel indicating the sequential folding sequence for the panel.

As shown in FIG. 11, the grooves 24*a*, 24*b* and 24*c* allow the tabs 36 to be folded towards the main sections 52 and 54, and for the main sections 52 and 54 to be folded relative to the latch section 53. The numbers 1 to 6 in FIG. 11 show the preferred folding sequence, which starts with the upper and lower tabs 36, then the side tabs 36, and then the main sections 52 and 54 towards the latch section 53. When folded, the main sections 52 and 54 are perpendicular to the latch section 53, with the main sections 52 and 54 being essentially parallel and spaced from each other.

Figure 12:
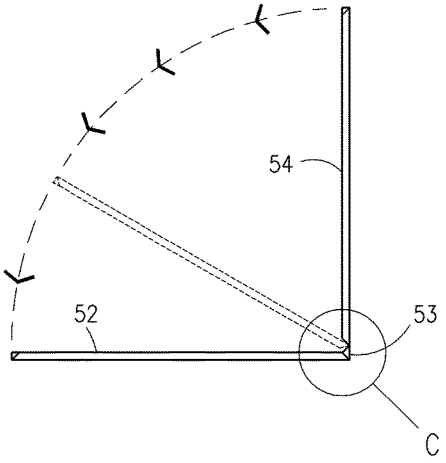
FIG. 12 is an end elevation view showing folding of the main sections of the panel of FIG. 1 relative to the latch section.
Figure 13:
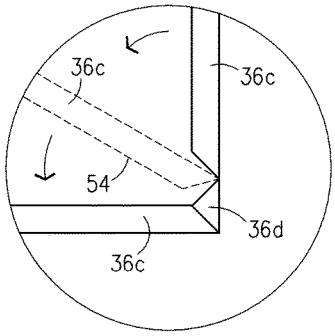
FIG. 13 is an enlarged lower end elevation view of the middle section of the panel of FIG. 1.
Figure 21:
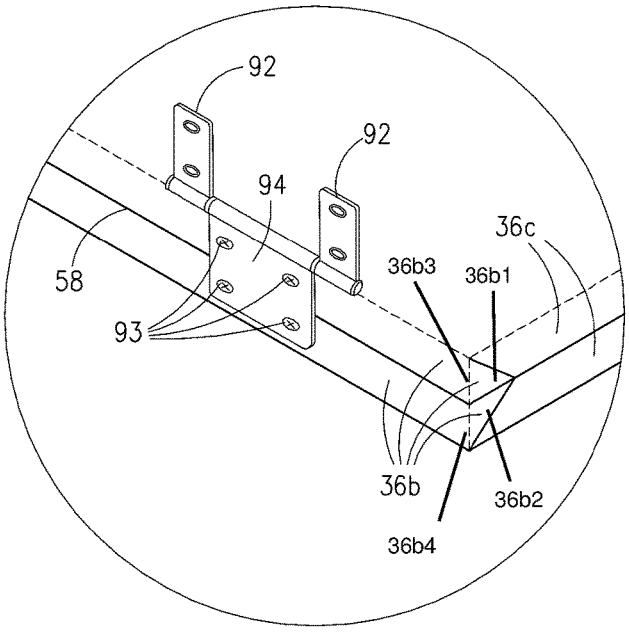
FIG. 21 is an enlarged perspective view of detail D of FIG. 20 showing the lower corner at the hinge face of the folded panel.
Figure 23:
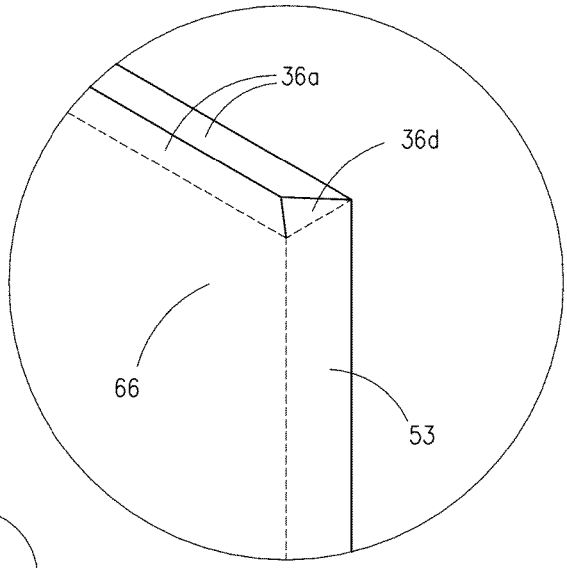
FIG. 23 is an enlarged perspective view of detail E of FIG. 20 showing the upper corner at the latch face of the folded panel.
Figure 22:
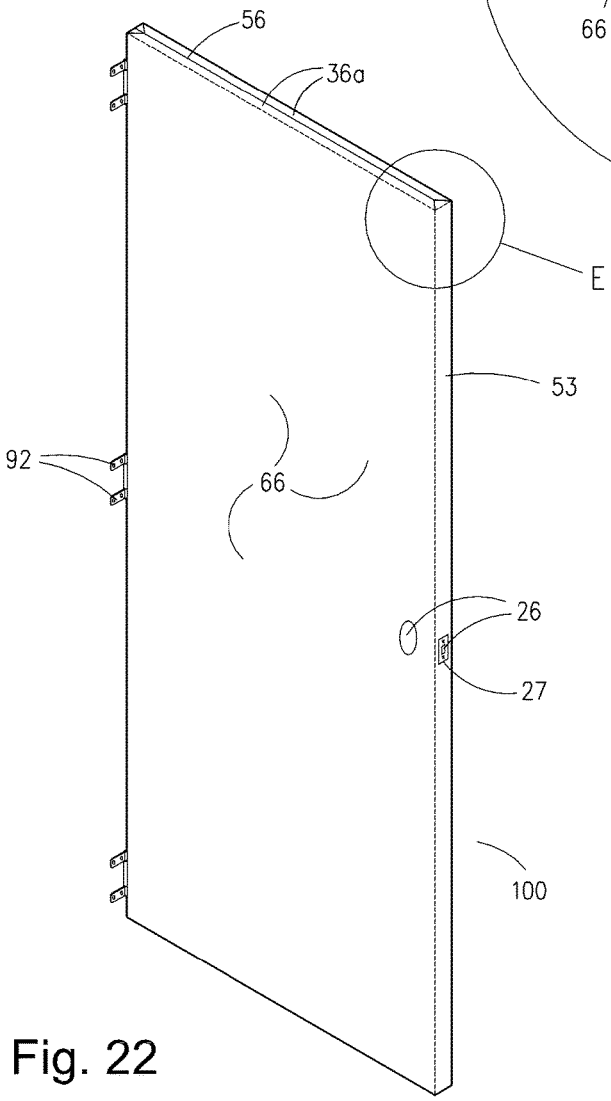
FIG. 22 is a first isometric view of the assembly of FIG. 22 with the door upright.
Figure 25:
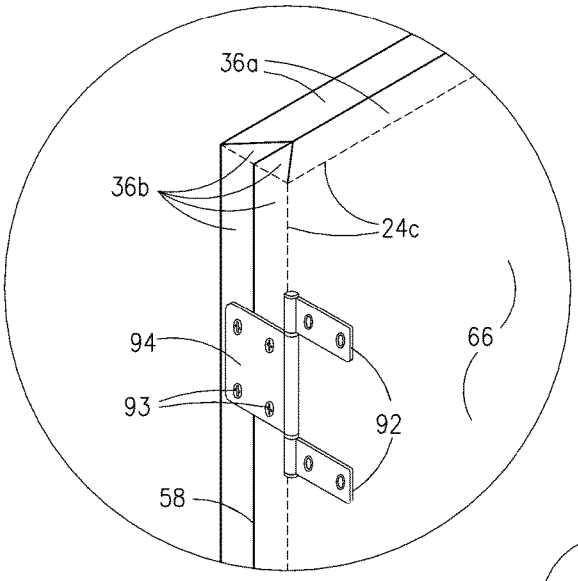
FIG. 25 is an enlarged perspective view of detail F of FIG. 24 showing the upper corner at the hinge face of the folded panel.
Figure 24:
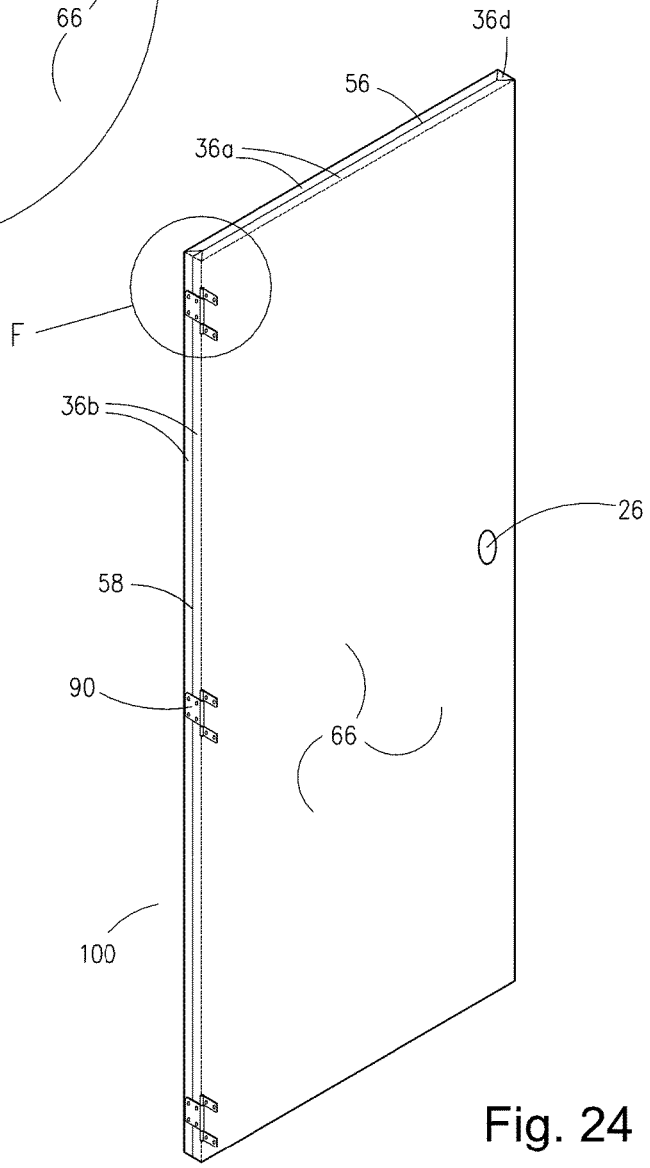
FIG. 24 is a second isometric view of the assembly of FIG. 22 with the door upright.
Figure 27:
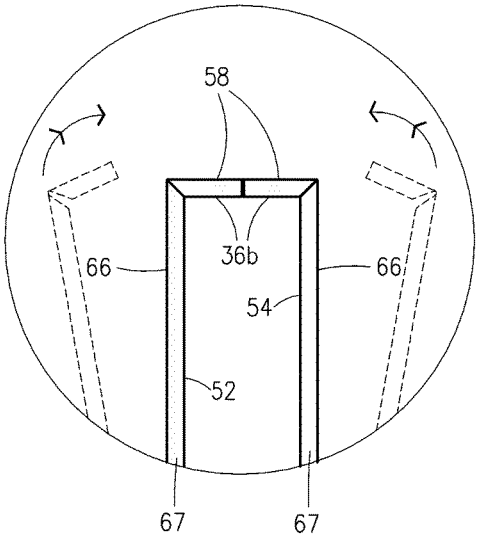
FIG. 27 is a cross-sectional view showing the folding of the main panels and the edge tabs of the hinge face towards each other.
Figure 29:
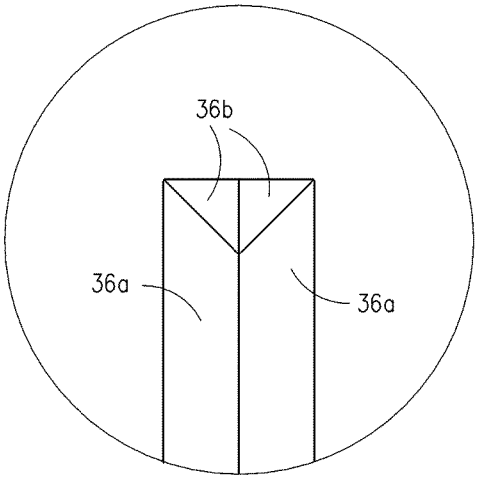
FIG. 29 is a top plan view showing the edge tabs folded at the hinge face.
Figure 26:
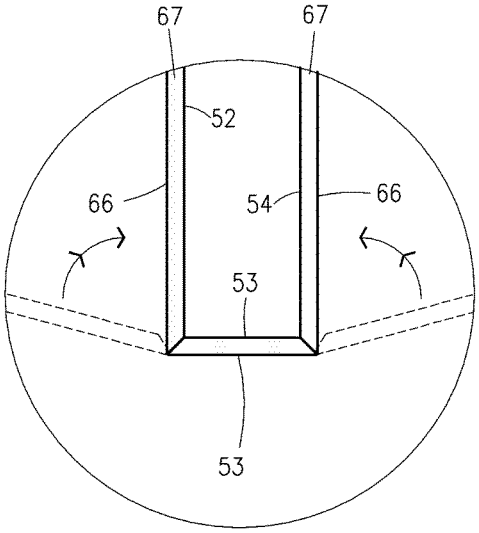
FIG. 26 is a cross-sectional view showing the folding of the main panels relative to the latch face.
Figure 28:
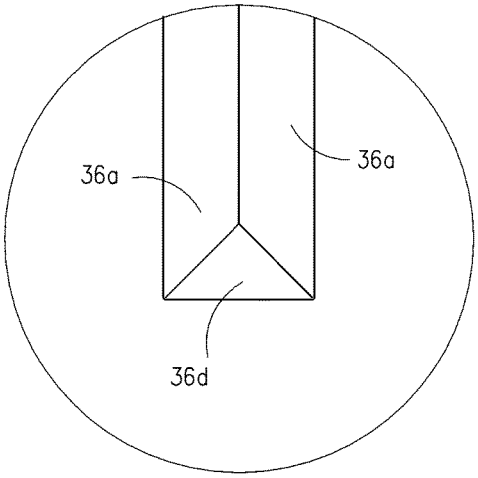
FIG. 28 is a top plan view showing the edge tabs folded at the latch face.

As shown in FIGS. 12 and 13, the grooves 24*c* allow the tabs 36 to be folded towards each other. The upper tabs 36*a* and triangular upper tabs 36*d* when folded towards each other are dimensioned to be contiguous to form an upper face 56 of the door 100. Similarly, the lower tabs 36*c* and triangular lower tabs 36*d* when folded towards each other are dimensioned to be contiguous to form a lower face 57 of the door 100. Referring to FIG. 21, the side tabs 36*b* when folded towards each other are also dimensioned to be contiguous to form a hinge face 58 of the door 100 and triangular portions 36*b*1, 36*b*2 of the side tabs 36*b* also become contiguous with the upper and lower tabs 36*a* and 36*c*. The tabs 36 together are contiguous and form substantially solid upper face 56, lower face 57 and hinge face 58 of the door 100. The upper and lower tabs 36*a*, 36*c* and triangular tabs 36*d* provide rounded folded edges extending from the main sections 52, 54 and the latch section 53. This substantially avoids the appearance of seams or edges when viewing the main sections 52, 54 and the latch section 53. The side tabs 36*b* also provide a round folded edge 36*b*3, 36*b*4 which avoids the appearance of seams. The external surface of the latch section 53 forms the latch face.

FIGS. 7 to 10 show alternative shapes for the upper and lower tabs 36*a*, 36*c* and triangular tabs 36*d*. As shown, the tab 36*d* can be shaped as desired and the adjacent edges of the tabs 36*a*/36*c* can be shaped accordingly to provide contiguous edges when folded.

Figure 14:
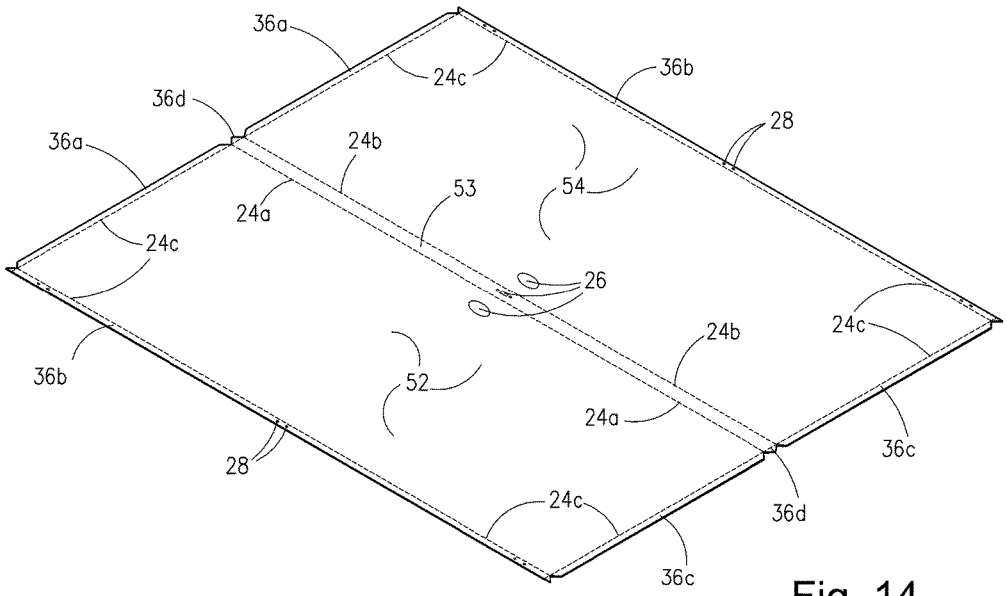
FIG. 14 is an isometric view of the unfolded panel.
Figure 15:
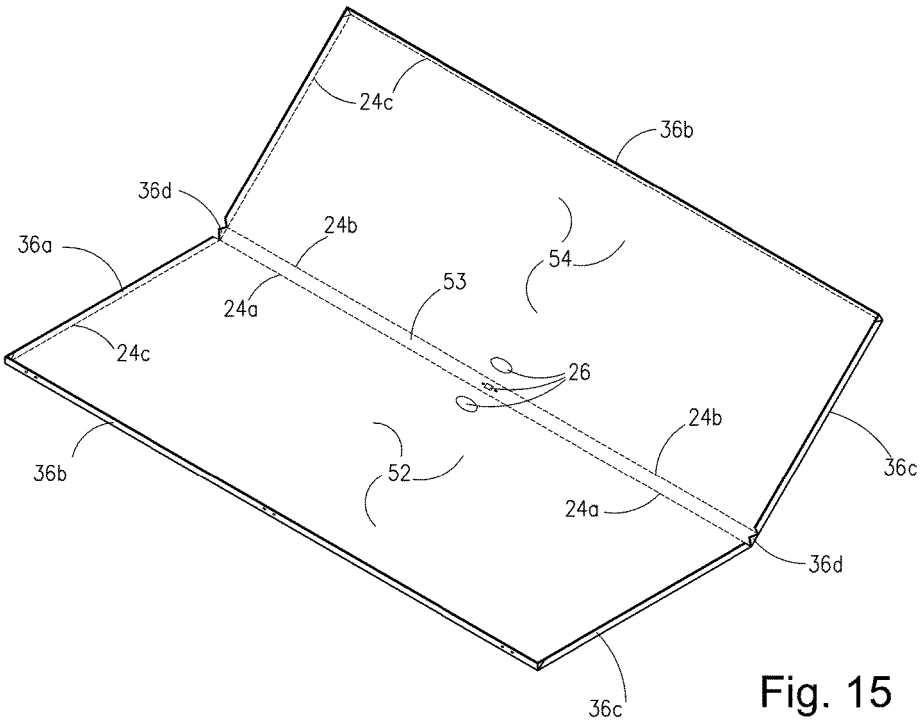
FIG. 15 is an isometric view of the panel of FIG. 14 in a partially folded configuration.

FIG. 14 shows an isometric view of the unfolded panel 20 and FIG. 15 shows the panel 20 in a partially folded configuration.

Figure 16:
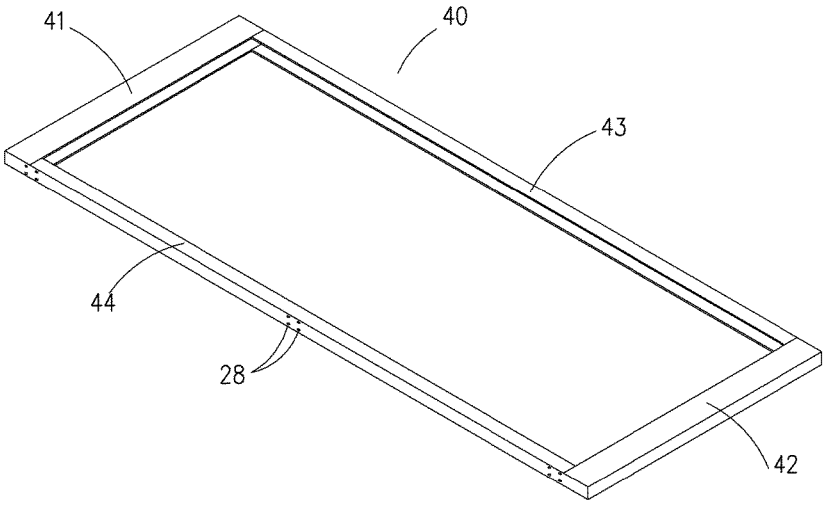
FIG. 16 is an isometric view of an internal frame for the door of the preferred embodiment of the present invention.
Figure 17:
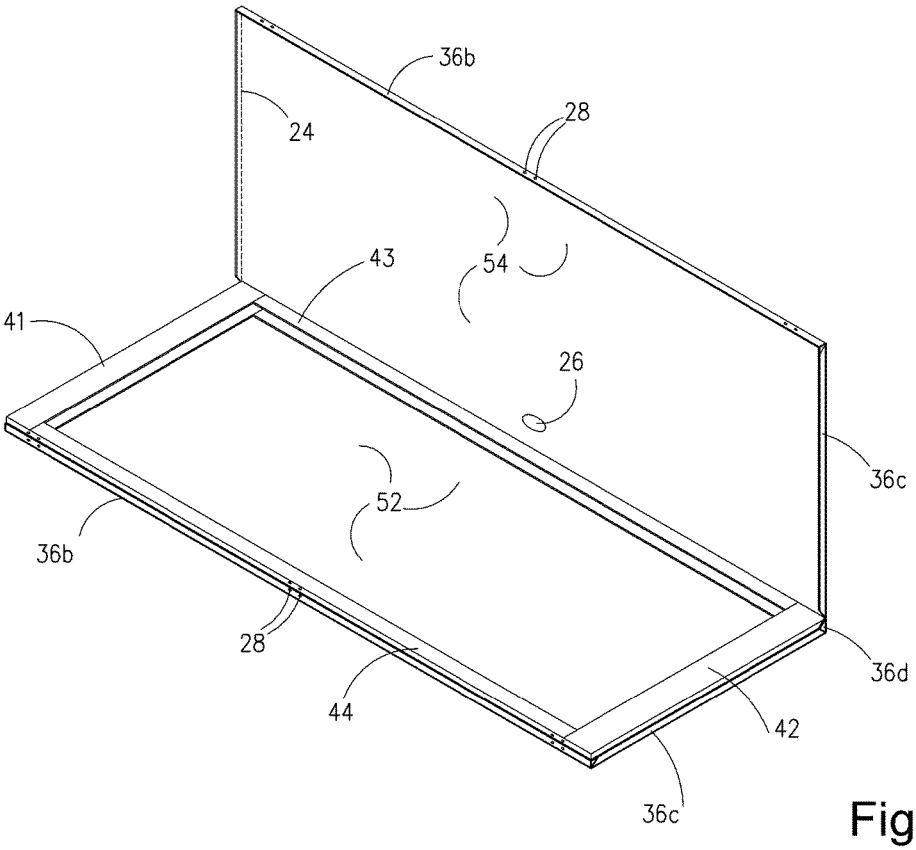
FIG. 17 is an isometric view showing the internal frame of FIG. 16 received in the partially folded panel of FIG. 15.

FIG. 16 shows a frame 40 for the door 100. The frame 40 comprises a top beam 41, a bottom beam 42, a latch beam 43 and a hinge beam 44. The beams 41 to 44 are hollow C-shaped beams. The frame 40 in the preferred embodiment is made from steel or aluminium. The frame 40 is dimensioned to be received within the folded panel 20 as shown in FIG. 17, with the beams 41 to 44 respectively disposed adjacent the upper face 56, lower face 57, latch section 53 and hinge face 58. The hinge beam 44 includes corresponding hinged mount apertures 28.

Figure 18:
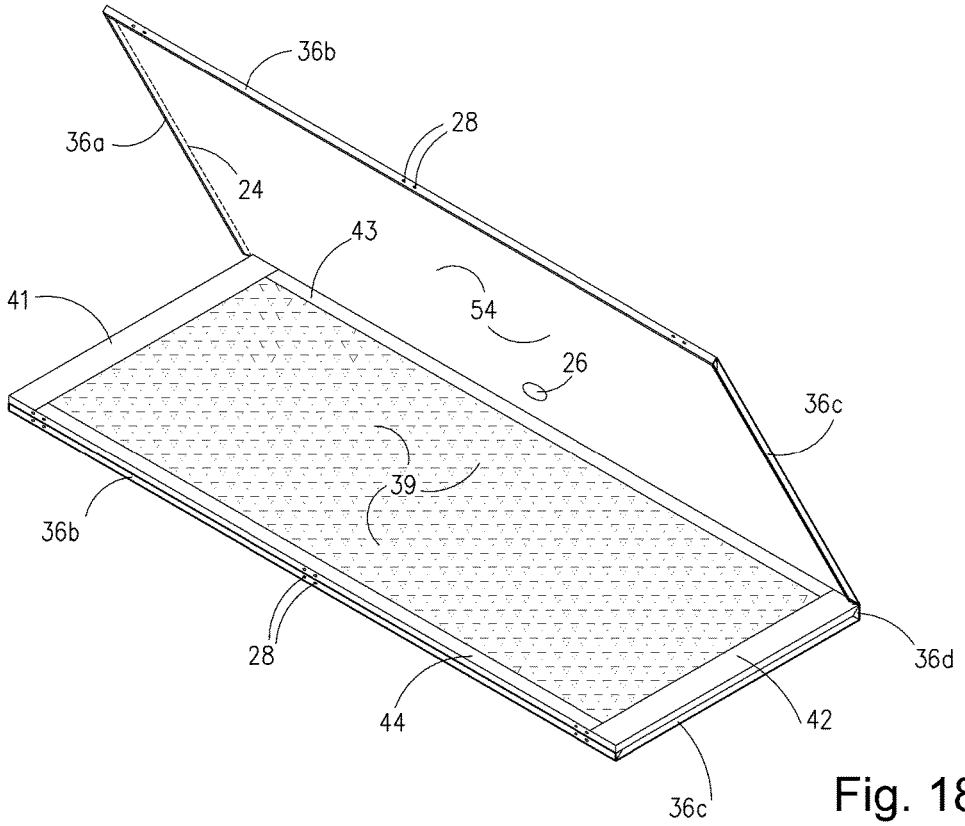
FIG. 18 is an isometric view showing the partially folded panel of FIG. 17 with additional infill material received in the internal frame.
Figure 19:
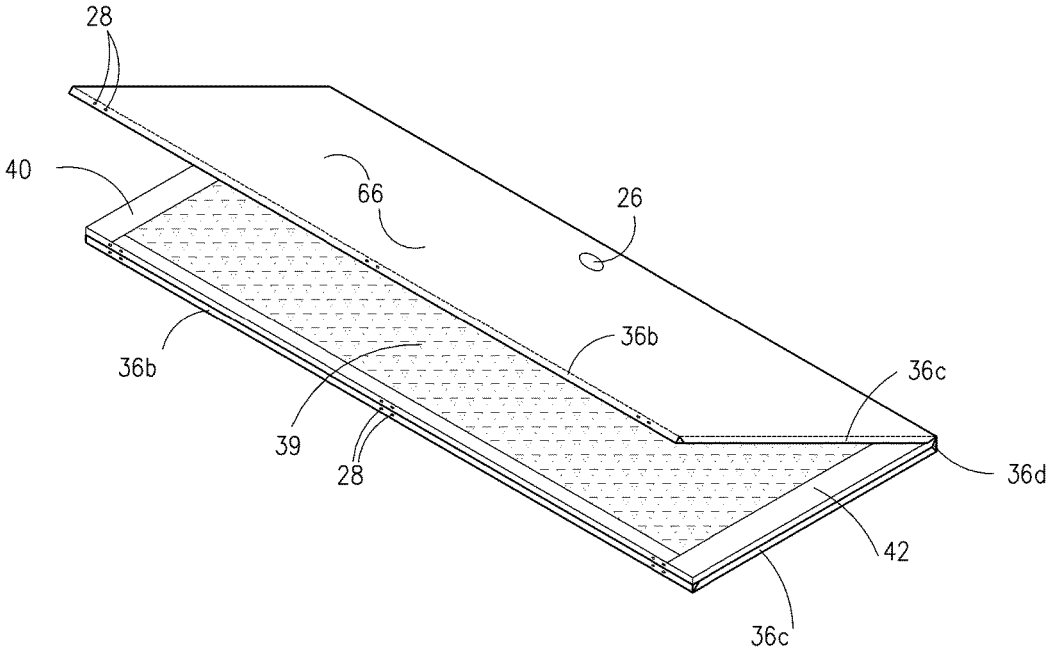
FIG. 19 is an isometric view of the assembly of FIG. 18 with the panel in a further folded configuration.
Figure 20:
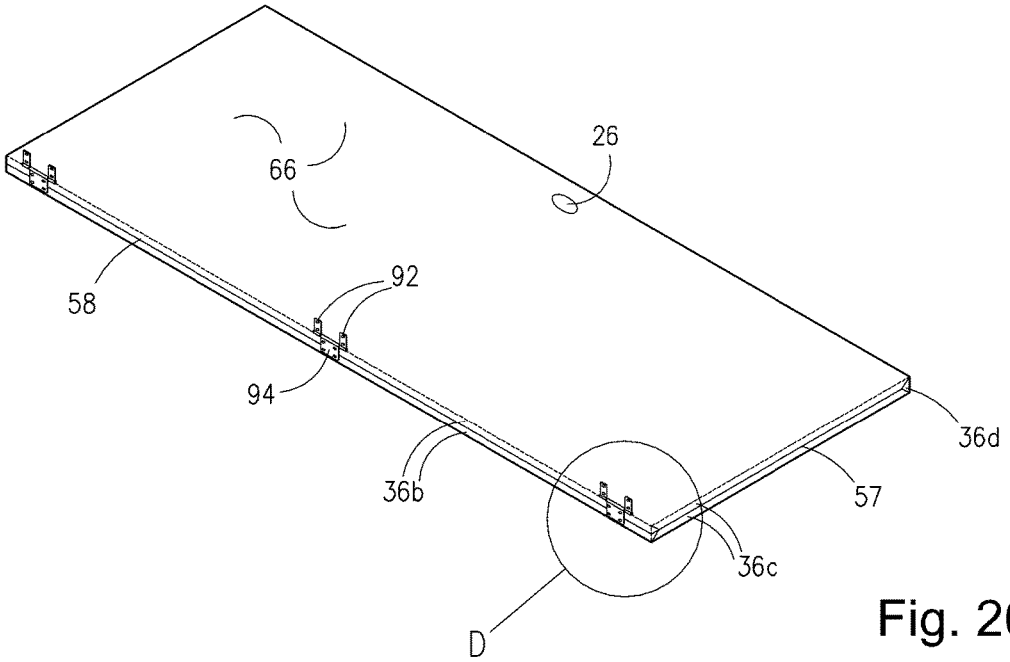
FIG. 20 is an isometric view of the assembly of FIG. 19 with the panel in a fully folded configuration and hinges attached to the hinge face.

As shown in FIGS. 18 and 19, infill material 39 is disposed within the door 100, between the frame beams 41 to 44. The infill material 39 can be any suitable material, but is preferably fireproof material, which can be in liquid form that expands and solidifies as foam. In the preferred form, the infill material is liquid polyurethane that sets to a solid lightweight form.

Once the frame 40 and the infill material 39 are disposed within the folded panel 20, the panel 20 can be fully folded, as shown in FIGS. 26 to 29. The tabs 36 are glued to the frame 40 which retains the panel 20 in its folded configuration and forms the door 100.

Figure 31:
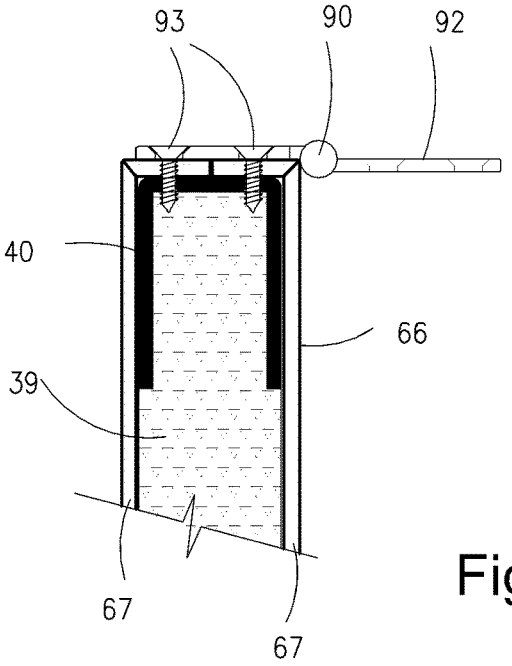
FIG. 31 is a cross-sectional view showing door construction at the hinge face.
Figure 30:
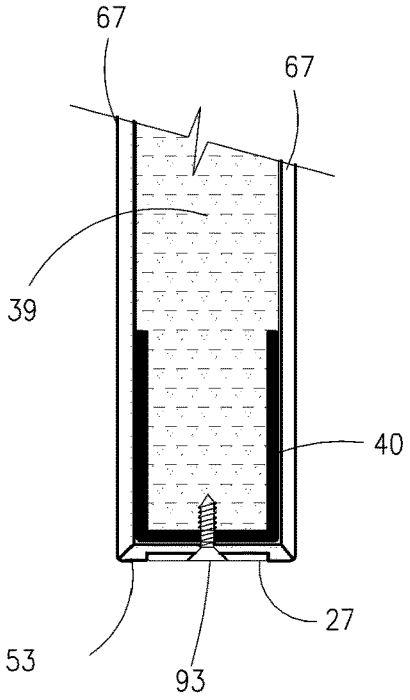
FIG. 30 is a cross-sectional view showing door construction at the latch face.
Figure 32:
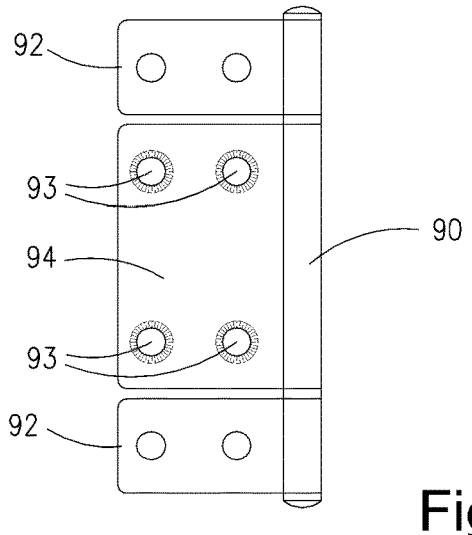
FIG. 32 is a front plan view of a hinge according to a preferred embodiment of the present invention in a closed configuration thereof.
Figure 33:
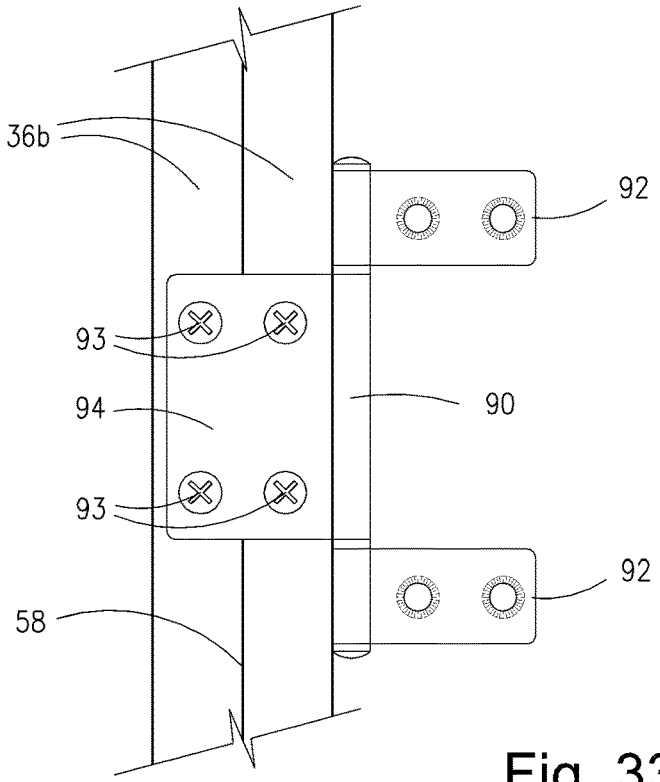
FIG. 33 is a front elevation view of the hinge attached to the hinge face of the door, with the hinge in an open configuration thereof.

FIGS. 32 and 33 show a hinge 90 for the door 100. The hinge 90 comprises upper and lower jamb mount sections 92 and a door mount section 94 pivotably attached to and between the jamb mount sections 92. The door mount section 94 comprises spaced apertures for receiving mounting screws 93 therethrough, the mounting screws 93 being inserted into the hinge mount apertures 28 of the adjacent side tabs 36*b* and into the frame 40 as shown in FIG. 31. The door mount section 94 thus assists in retaining the door panel 20 in its folded configuration. The jamb mount sections 92 are for mounting to a door jamb of a building structure. As shown in FIG. 30, the latch plate 27 can be attached by similar screws 93.

The hinge 90 provides the advantage in that it is not recess mounted and is symmetrical. This allows the orientation of the hinge 90 to be reversed on the door 100 for providing a left or right side opening door as desired.

FIGS. 20 to 25 show the finished door 100. The folded panel 20 results in the latch face 53 being a seamless fold.

The door 100 maintains simplicity in construction, using a single panel of composite aluminium, cut to the required size. Grooves 24 are carved at the required positions and dimensions, and folded at the top, bottom and hinged face of the door. The door 100 can be considered as completely pre-finished which requires no painting, and can be completely pre-assembled (hinged and latched) offsite and delivered on site as a working unit, ready for simple installation.

The folded sections meet at the centre of the top, bottom and hinged sides of the door are screwed and glued to the door frame 40. The depth of the hinges 90 covers the side tabs 36*b* hinged face, and locks the sections together.

The door frame 40 can be made from Aluminium, Medium Density Fibreboard (MDF) or High Density Plastic (HDP) to suit specific applications. Using varying insulation materials 39 between the door frame 40, the door 100 would be suitable as fire doors (fire rated), acoustic doors (sound proof) or thermal doors (for use as external doors).

The use of composite aluminium panels provides pre-finished doors of the highest quality that are suitable for many applications. The doors 100 is also suitable to have glass insert panels, and as such can be used for feature doors and front entry doors. The glass panels in such an embodiment will be mounted to the main panels and the material 39 can be omitted to have a hollow cavity within the frame 40 or the material 39 can be a transparent plastics block.

The present invention provides an improvement on the conventional door construction, and uses composite aluminium panels that are cut and folded to form a substantially seamless door. The present invention allows for door units to be completely pre-finished and pre-assembled in the factory with greater accuracy, whilst providing for easy onsite installation.

There are many possible alternative embodiments to the present invention.

The present invention provides a means for completely pre-finished door units to be manufactured, without any visible construction joints, resulting in a seamless door, having the appearance of a solid mass, and the hinge face of the door being partially hidden by the door jamb.

The present embodiment provides a door that is formed entirely out of a single panel of composite aluminium, having no visible joins in the external faces. The composite aluminium panel is cut and grooved in such a way that the joins are located only at the top, bottom and hinged sides of the door, providing the latched side with a seamless face. The composite aluminium panel provides a skin over a standard type door frame construction, with the door frame material varying from Aluminium, Medium Density Fibreboard (MDF) or High Density Plastic (HDP) to suit specific applications. Using varying insulation materials between the door frame, the high performance doors would be suitable as fire doors (fire rated), acoustic doors (sound proof) and thermal doors (external doors). The use composite aluminium panels in this innovative way, provides pre-finished doors of the highest quality that are suitable for many applications.

Whilst preferred embodiments of the present invention have been described, it will be apparent to skilled persons that modifications can be made to the embodiments described.

The tabs 36 can also be configured differently. For example, only one of the main sections 52 and 54 can have a tab 36 which extends across the width of the door. In this embodiment, the other main section does not require a tab 36.

The panel can alternatively be made from an aluminium or other metal sheet, and does not have to be a composite panel. In such an embodiment, folding grooves can be formed in the panel surface. As a further alternative, the panel can be made from plastics material, either bent or folded into shape, while cold or partly heated.

In another possible embodiment, the panel can be a flexible film such as an adhesive vinyl wrap which is folded over a door to provide finished latch and main faces to the door.

The preferred embodiment provides the following advantages:

- Completely pre-finished door surfaces having seamless visible edges
- A door manufactured from a single aluminium composite panel A liquid polyurethane core that sets to a solid lightweight form Heavy duty construction with structural aluminium frame Relatively lightweight High level of security Has great acoustic and thermal properties Water proof UV resistant Will not swell or distort.

Unique manufacturing process on computer numerical control (CNC) machine

Can be made into fire doors containing fire retardant polyurethane core

In another aspect, the present invention provides a method for forming an aluminium composite panel. The method involves multi stage curing of thermosetting plastic for manufacture of fire proof aluminium composite panels.

In order to be used as a core material for manufacture of aluminium composite panels, the thermosetting plastic needs to be partially cured so that it is pliable and can be extruded into a continuous sheet.

The partially cured thermosetting core allows the panel to be folded and bent into required shapes.

Upon completion of the folding and bending, the partially cured thermosetting plastic core composite aluminium panel can be further cured to set the thermoplastic core hard.

The further curing of the thermosetting plastic aluminium composite panels can be achieved by means of heat, radiation or combination of both thereof to the desired hardness.

The use of a multi stage curing of thermosetting plastic as a core in manufacture of aluminium composite panel now gives opportunity for panels to be used as fire rated doors, which retain the structural integrity when exposed to fire.

Aluminium composite panels manufactured with a thermosetting plastic core provides a perfect solution as it becomes harder when heat is applied.

The behaviour of the thermosetting plastic is similar to clay in that the clay is pliable and able to be shaped, and sets hard when heat is applied.

The thermosetting plastic in a raw state is essentially is a resin which is too sticky and runny to be used as a core material for manufacture of aluminium composite panels.

Since the aluminium composite panel produced is more rigid, it is possible to make the composite panel without an inner skin of aluminium i.e. two layers only being the outer aluminium panel and the thermosetting plastic. This is currently not possible in other aluminium composite panels as the plastic core used in such previous panels is too soft.

The thermoset aluminium composite panel can be used for all current fabrications with the option of tertiary curing, giving the ability to mould panels to shape. This can eliminate the need for fireproof inserts in wall "tray" panel.

Stage 2 curing after extrusion is used to mimic the viscosity of the current PE (polyethelene) core. The multi-stage curing is to allow the aluminium composite panel material to be produced in the existing machinery with little or no modifications. Curing after fabrication produces a more durable material with high modulus and resistant to damage especially on the folded edges.

It is also possible to add particles of recycled thermoplastic to increase the viscosity at stage 1 as a "green" solution. Utilizing the thermoset plastic provides a much stronger aluminium composite panel which gets harder when subjected to heat, which is ideal for a fire door skin. The hinge has been designed to be reversible so that the door can be made a right or left handed door by simply unscrewing the hinge and reversing it. No cutting or drilling is needed. The door and hinge have matching symmetry.

The hinge is also used as a method of locating, retaining and fixing our door frame section within the door skin (panel) and locking the skin (folded panel) together.

Figure 34:
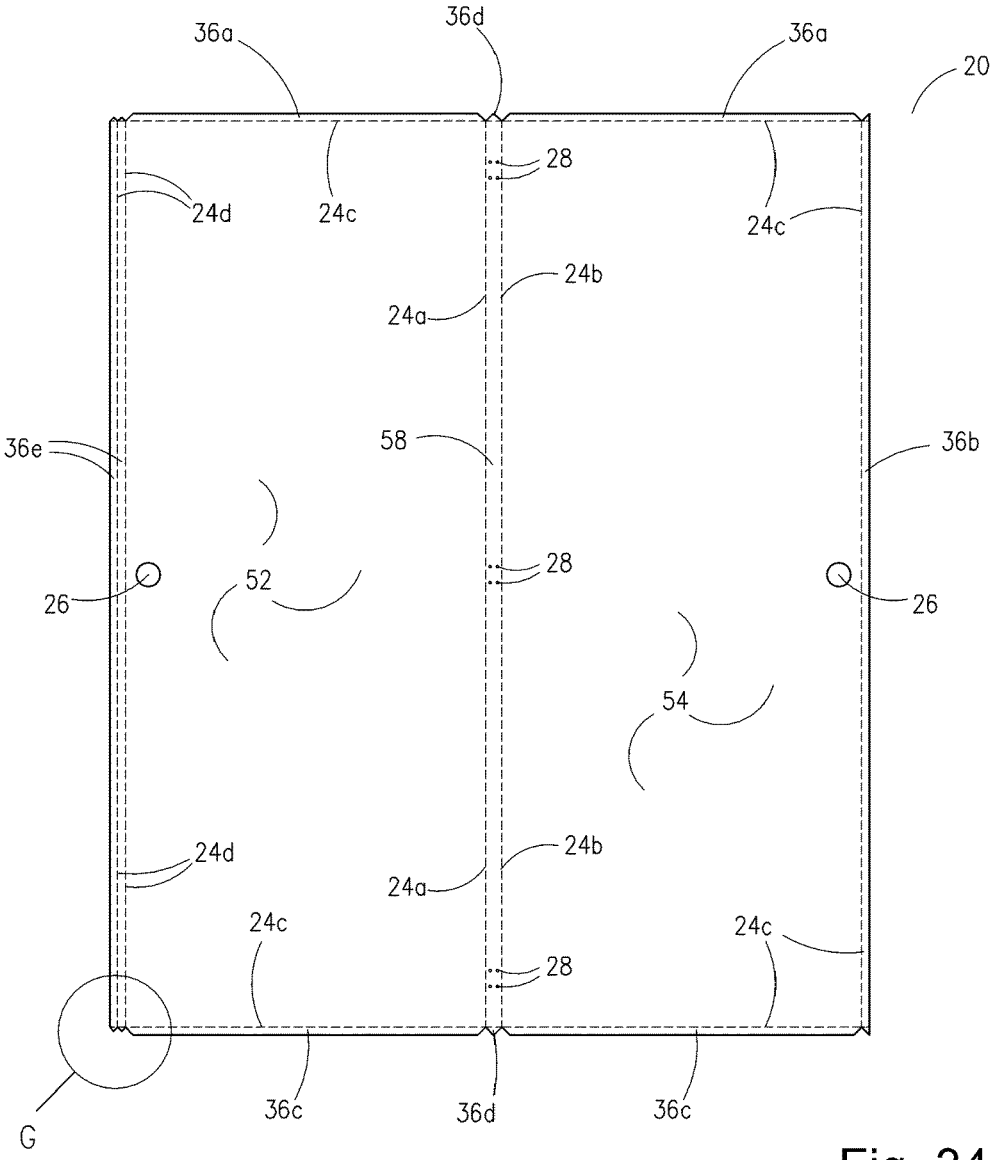
FIG. 34 is a front elevation view of an internal surface of an unfolded panel for a double rebate door assembly according to a second embodiment of the present invention.
Figure 35:
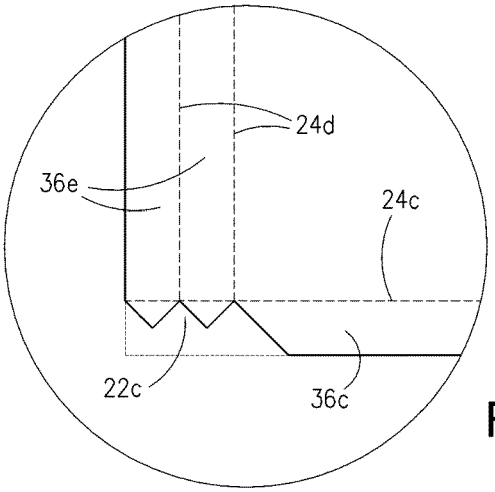
FIG. 35 is an enlarged elevation view of detail G of FIG. 34 showing the lower left panel corner portion at the latch face of the door.
Figure 37:
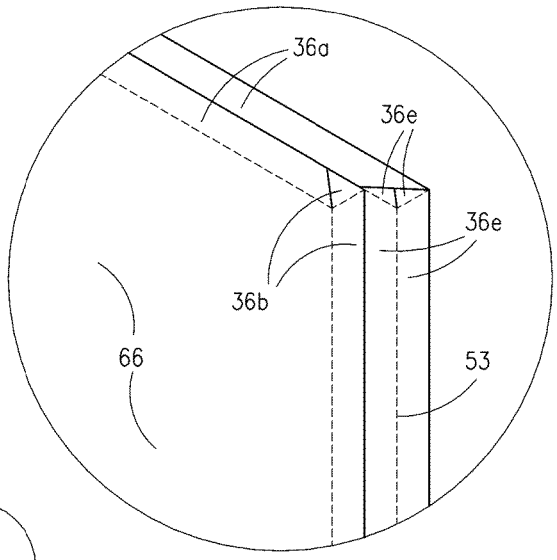
FIG. 37 is an enlarged perspective view of detail H of FIG. 36 showing the upper latch face corner portion of the door with the double rebate.
Figure 36:
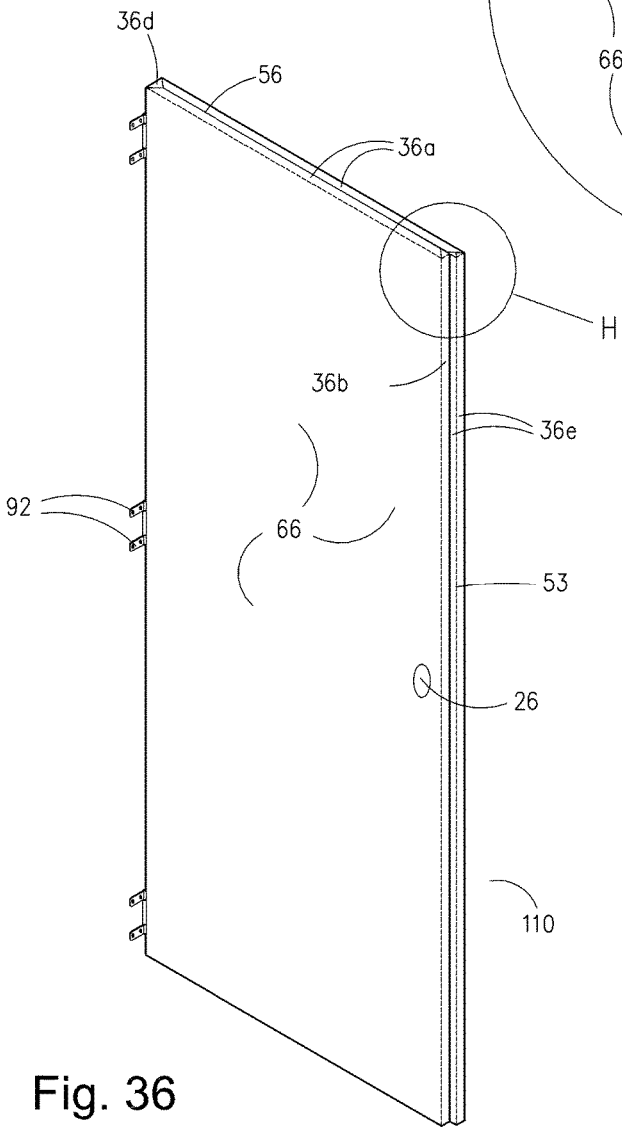
FIG. 36 is an isometric view of a double rebate door assembly according to the second embodiment.
Figure 39:
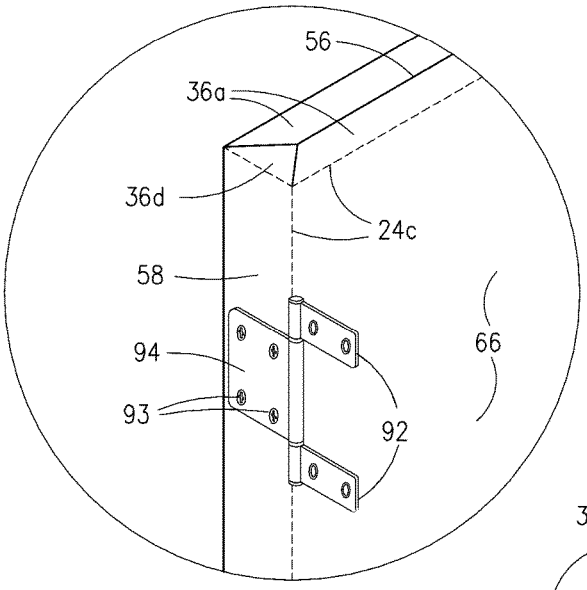
FIG. 39 is an enlarged perspective view of detail I of FIG. 38 showing the upper hinge face corner portion of the door.
Figure 38:
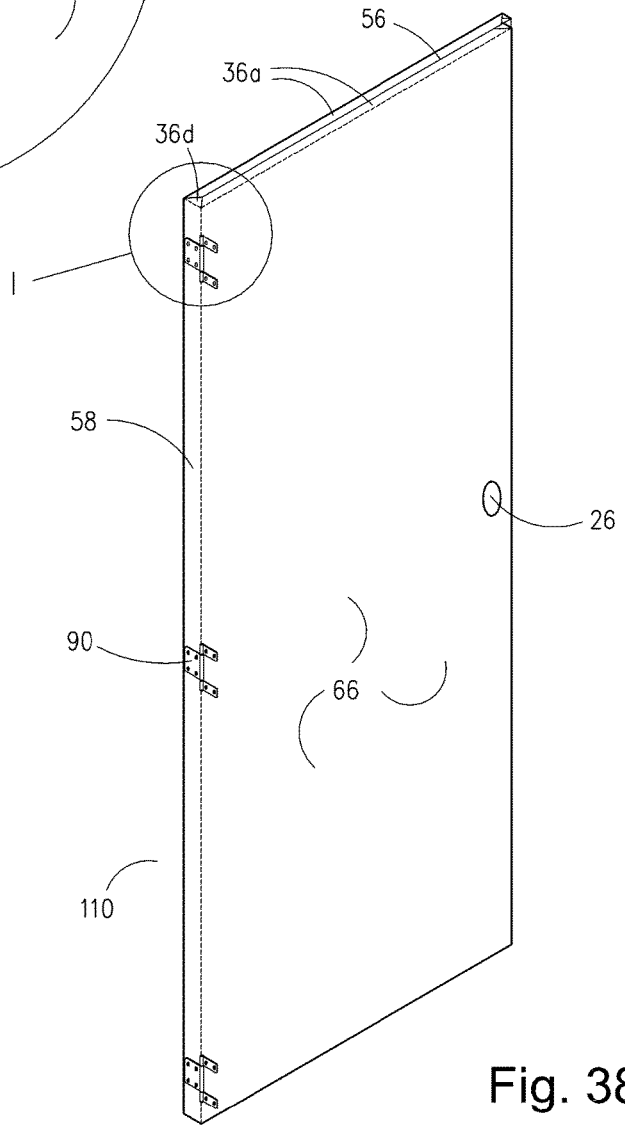
FIG. 38 is another isometric view of a double rebate door assembly according to the second embodiment.
Figure 41:
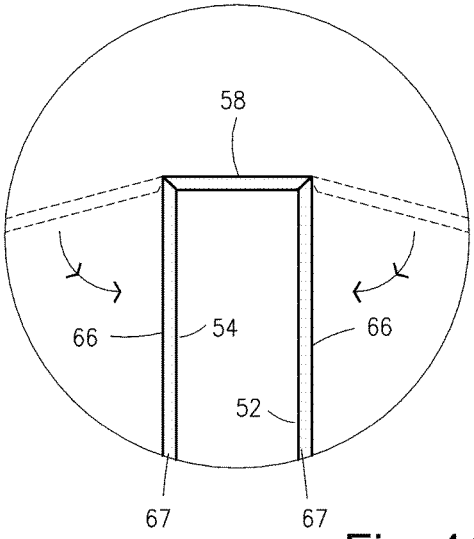
FIG. 41 is a cross-sectional view showing the folding of the main panels relative to the hinge panel for the double rebate door assembly.
Figure 43:
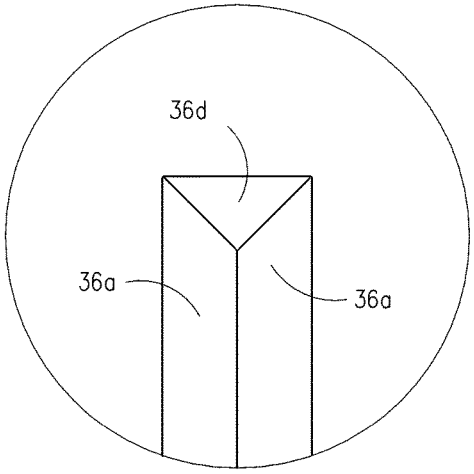
FIG. 43 is a top plan view showing the edge tabs folded at the hinge face.

FIGS. 34 to 45 refer to the formation of a door 110 according to a second embodiment. The door 110 differs from the door 100 above in that the door 110 has a double rebate at the latch section 53 as best shown in FIGS. 36 and 37.

Figure 40:
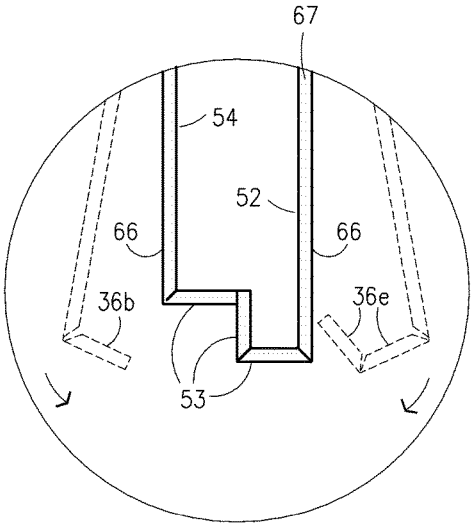
FIG. 40 is a cross-sectional view showing the folding of the main panels and the edge tabs of the latch face towards each other for the double rebate door assembly.
Figure 42:
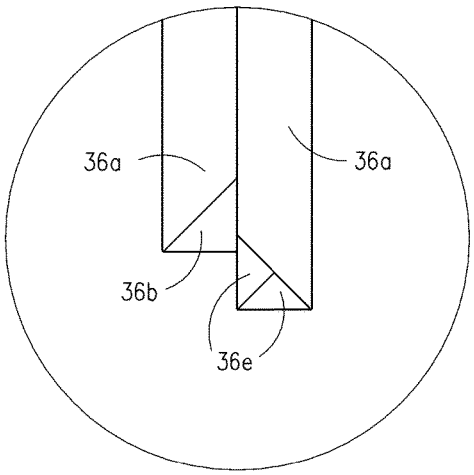
FIG. 42 is a top plan view showing the edge tabs folded at the latch face.
Figure 44:
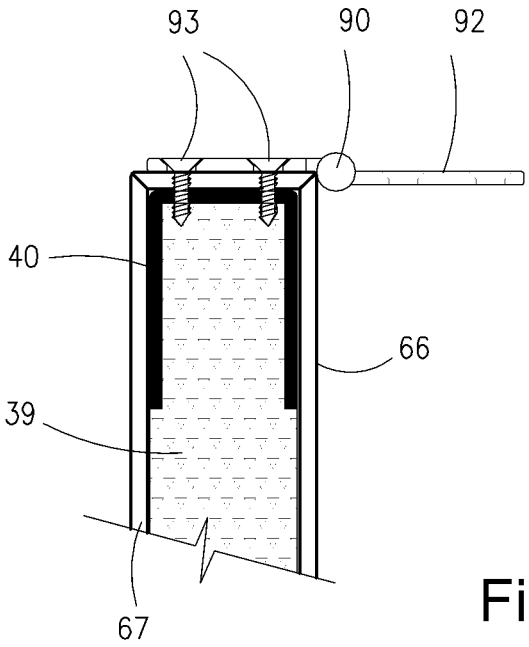
FIG. 44 is a cross-sectional view showing door construction at the hinge face for the double rebate door assembly.

Referring to FIGS. 34 and 35, the hinge face 58 is formed between the main sections 52 and 54. The latch section 53 in this embodiment will be formed by modified side tabs 36*e* joining with side tab 36*b*. The main section 52 is formed slightly wider than the other main section 54. The edge of the main section 52 comprises two parallel grooves 24*d* which forms two side tabs 36*e*. As shown in FIGS. 40 and 42, the two side tabs 36*e* are folded in series and the distal edge of the tab 36*e* engages the edge of the other side tab 36*b*. The upper and lower triangle portions of the tabs 36*e* are also folded to be contiguous with the upper and lower tabs 36*a* and 36*c*.

Figure 45:
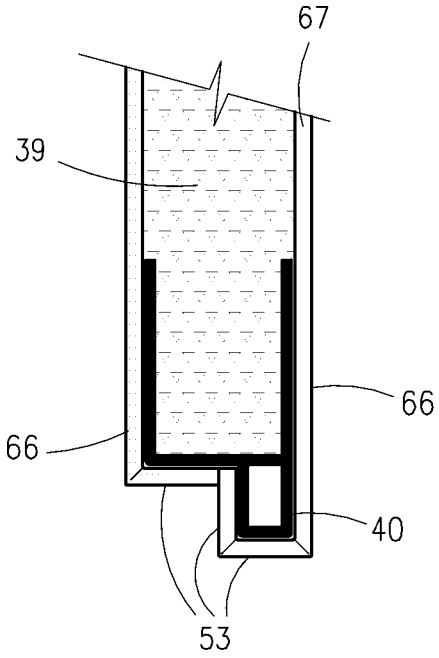
FIG. 45 is a cross-sectional view showing door construction at the latch face for the double rebate door assembly.

As shown in FIG. 45, the frame 40 is modified to provide the double rebate shape and support the additional folded tabs 36*e*.

Figure 46:
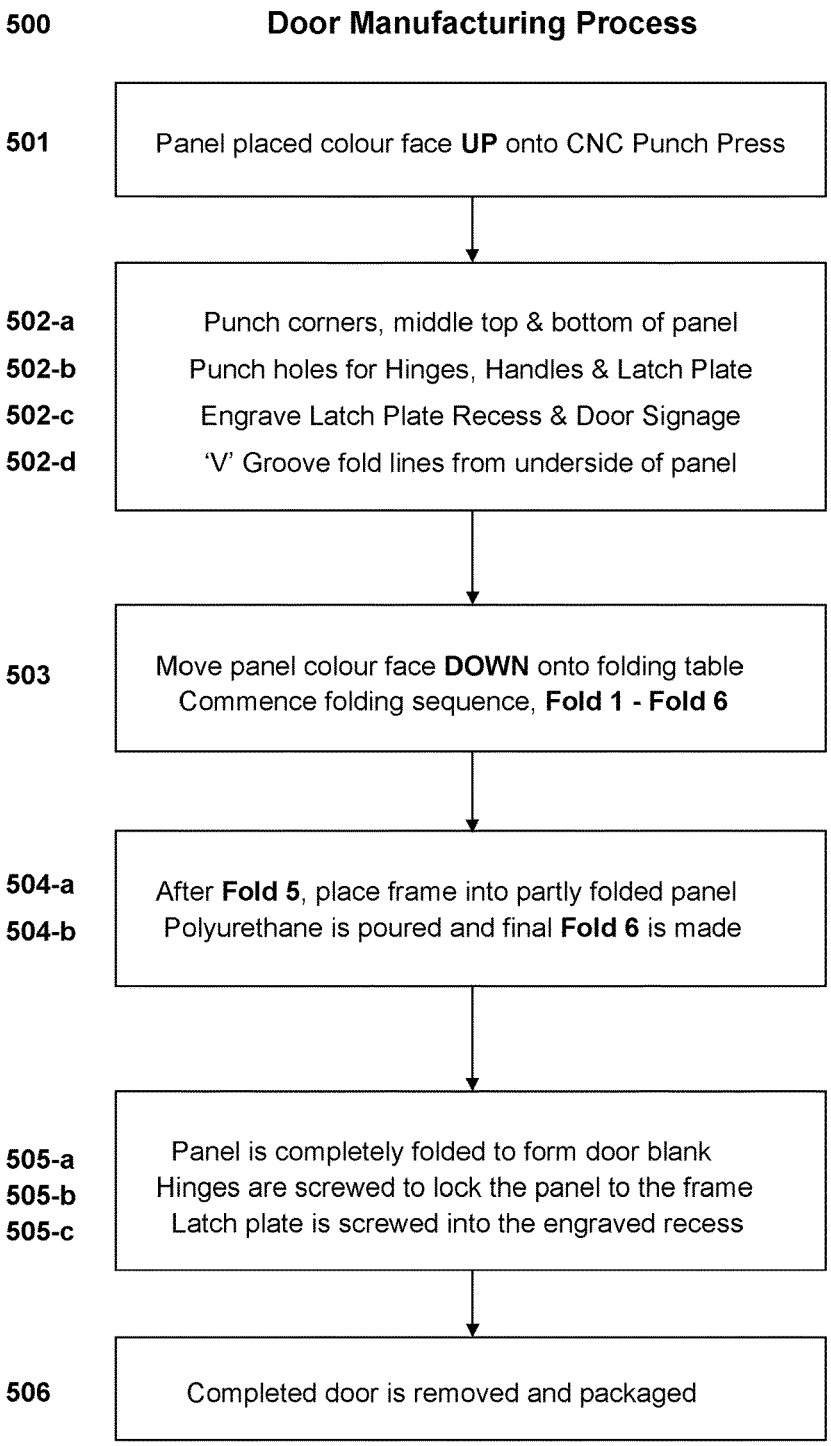
FIG. 46 is a schematic illustration of a process outline of the manufacturing process for the door assembly of the preferred embodiment.

FIG. 46 shows the steps in a door manufacturing process 500 according to the present invention. The door manufacturing process 500 can be substantially completely automated, and manufactured on two machines.

Step 501 shows placement of the composite panel face up onto a CNC Punch Press machine.

Step 502 shows punching of all cutout shapes (hinge holes, latch holes, tab cut-outs), engraving of sheet for the latch plate, and cutting the V-shaped folding grooves in the panel. The corners and Top/Bottom centre sheet notched (punched)

Step 503 shows the panel is moved to an inverter where the panel is flipped and moves face down to a folding table and the folding sequence is commenced.

Step 504 shows insertion of the frame into the partly folded panel and pouring of the foam core. The final fold 6 is then made to close the door.

Step 505 shows the attachment of the hinges to lock the folded panel and attachment of the latch plate into the latch plate recess.

Step 506 shows the completed door is removed and packaged. The only manual work presently needed is the screwing of the hinges and removing the folded door from the folding table.

I claim:

1. A door, comprising:

a single panel having an upper edge, a lower edge opposite said upper edge, a first side edge, a second side edge opposite said first side edge, said single panel being comprised of an inner sheet, an outer sheet, and a core between said inner sheet and said outer sheet, wherein said single panel comprises:

a first main section defined by said upper edge, said first side edge, said lower edge and a first V-shaped groove, said first V-shaped groove extending from said upper edge to said lower edge in a mid portion of the panel;

a second main section defined by said upper edge, said second side edge, said lower edge and a second V-shaped groove, said second V-shaped groove extending from said upper edge to said lower edge in said mid portion of the panel; and a latch section between said first main section and said second main section, said latch section being defined by said upper edge, said lower edge, said first V-shaped groove, and said second V-shaped groove, wherein said first V-shaped groove and said second V-shaped groove are parallel to each other, wherein said first main section is folded along said first V-shaped groove relative to said latch section, said outer sheet of said first main section forming a first main face, wherein said second main section is folded along said second V-shaped groove relative to said latch section, said outer sheet of said second main section forming a second main face, wherein said outer sheet of said latch section forms a latch face, said first main face being parallel to said second main face, wherein said first side edge and said second side edge form a hinge face, wherein said upper edge comprises an upper additional groove in said inner sheet, a first upper cutout between said first main section and said latch section, and a first upper side cutout between said first main section and said first side edge so as to form a first main section upper edge tab, a second upper cutout between said second main section and said latch section, and a second upper side cutout between said second main section and said second side edge so as to form a second main section upper edge tab and a latch section upper edge tab, wherein said lower edge comprises a lower additional groove in said inner sheet, a first lower cutout between said first main section and said latch section, and a first lower side cutout between said first main section and said first side edge so as to form a first main section lower edge tab, a second lower cutout between said second main section and said latch section, and a second lower side cutout between said second main section and said second side edge so as to form a second main section lower edge tab and a latch section lower edge tab, wherein said first side edge comprises a first side additional groove, said first side additional groove, said first upper side cutout, and first lower side cutout forming a first side edge tab, wherein said second side edge comprises a second side additional groove, said second side additional groove, said second upper side cutout, and second lower side cutout forming a second side edge tab, wherein said first main section upper edge tab, said latch section upper edge tab, and said second main section upper edge tab are folded toward each other so as to form an upper face, wherein said first main section lower edge tab, said latch section lower edge tab, and said second main section lower edge tab are folded toward each other so as to form a lower face, wherein said first side edge tab and said second side edge tab are folded toward each other so as to form said hinge face, wherein said latch section upper edge tab is triangular, wherein said first main section upper edge tab and said second main section upper edge tab have shapes complementary to said latch section upper edge tab, said first main section upper edge tab being contiguous with said second main section upper edge tab and said latch section upper edge tab so as to form said upper face, wherein said latch section lower edge tab is triangular, wherein said first main section lower edge tab and said second main section lower edge tab have shapes complementary to said latch section lower edge tab, said first main section lower edge tab being contiguous with said second main section lower edge tab and said latch section lower edge tab so as to form said lower face, wherein said first side edge tab has a first upper side edge tab portion and a first lower side edge tab portion;

wherein said second side edge tab has a second upper side edge tab portion and a second lower side edge tab portion;

wherein said first side edge tab is contiguous with said second side edge tab so as to form said hinge face, said first upper side edge tab portion being contiguous with said first main section upper edge tab so as to form said upper face with a corresponding rounded folded edge on said hinge face, said second upper side edge tab portion being contiguous with said second main section upper edge tab so as to form said upper face with a corresponding rounded folded edge on said hinge face, said first lower side edge tab portion being contiguous with said first main section lower edge tab so as to form said lower face with a corresponding rounded folded edge on said hinge face, said second lower side edge tab portion being contiguous with said second main section lower edge tab so as to form said lower face with a corresponding rounded folded edge on said hinge face.

2. The door, according to claim 1, wherein the panel is comprised of a composite material, and wherein said first V-shaped groove and said second V-shaped groove extending to said core from said inner sheet toward said outer sheet.

3. The door, according to claim 2, wherein said core is comprised of a thermosetting plastic.

4. The door, according to claim 1, further comprising:

infill material disposed between said inner sheet corresponding to said first main section and said inner sheet corresponding to said second main section.

5. The door, according to claim 4, wherein said infill material is positioned between said inner sheet corresponding to said first main section and said inner sheet corresponding to said second main section.

6. The door, according to claim 5, wherein said infill material is selected from a group consisting of polyurethane and polyethylene.

7. The door, according to claim 1, further comprising:

fireproof material disposed between said inner sheet corresponding to said first main section and said inner sheet corresponding to said second main section.

8. The door, according to claim 1, further comprising:

a frame disposed between said inner sheet corresponding to said first main section and said inner sheet corresponding to said second main section.

9. The door, according to claim 1, further comprising:

a hinge having a door mount section attached to said first side edge tab and said second side edge tab of said hinge face.

10. The door, according to claim 1, wherein the panel is comprised of a flexible wrap material.

11. A method of forming a door, the method comprising:

assembling a single panel having an upper edge, a lower edge opposite said upper edge, a first side edge, a second side edge opposite said first side edge, said single panel being comprised of an inner sheet, an outer sheet, and a core between said inner sheet and said outer sheet;

forming a first V-shaped groove extending from said upper edge to said lower edge in a mid portion of the panel, wherein said upper edge, said first side edge, said lower edge and said first V-shaped groove define a first main section;

forming a second V-shaped groove extending from said upper edge to said lower edge in said mid portion of the panel, wherein said upper edge, said second side edge, said lower edge and said second V-shaped groove define a second main section;

forming a latch section between said first main section and said second main section, said latch section being defined by said upper edge, said lower edge, said first V-shaped groove, and said second V-shaped groove, wherein said first V-shaped groove and said second V-shaped groove are parallel to each other, folding said first main section along said first V-shaped groove relative to said latch section, said outer sheet of said first main section forming a first main face;

folding said second main section along said second V-shaped groove relative to said latch section, said outer sheet of said second main section forming a second main face, wherein said outer sheet of said latch section forms a latch face, said first main face being parallel to said second main face, and wherein said first side edge and said second side edge form a hinge face;

forming a first main section upper edge tab in said upper edge with an upper additional groove in said inner sheet, a first upper cutout between said first main section and said latch section, and a first upper side cutout between said first main section and said first side edge;

forming a second main section upper edge tab and a latch section upper edge tab with a second upper cutout between said second main section and said latch section, and a second upper side cutout between said second main section and said second side edge;

forming a first main section lower tab in said lower edge with a lower additional groove in said inner sheet, a first lower cutout between said first main section and said latch section, and a first lower side cutout between said first main section and said first side edge;

forming a second main section lower edge tab and a latch section lower edge tab with a second lower cutout between said second main section and said latch section, and a second lower side cutout between said second main section and said second side edge;

forming a first side edge tab with a first side additional groove, said first side additional groove, said first upper side cutout, and first lower side cutout;

forming a second side edge tab with a second side additional groove, said second side additional groove, said second upper side cutout, and second lower side cutout;

folding said first main section upper edge tab, said latch section upper edge tab, and said second main section upper edge tab toward each other so as to form an upper face;

folding said first main section lower edge tab, said latch section lower edge tab, and said second main section lower edge tab toward each other so as to form a lower face;

folding said first side edge tab and said second side edge tab toward each other so as to form said hinge face, wherein said latch section upper edge tab is triangular, wherein said first main section upper edge tab and said second main section upper edge tab have shapes complementary to said latch section upper edge tab, said first main section upper edge tab being contiguous with said second main section upper edge tab and said latch section upper edge tab so as to form said upper face, wherein said latch section lower edge tab is triangular, wherein said first main section lower edge tab and said second main section lower edge tab have shapes complementary to said latch section lower edge tab, said first main section lower edge tab being contiguous with said second main section lower edge tab and said latch section lower edge tab so as to form said lower face, wherein said first side edge tab has a first upper side edge tab portion and a first lower side edge tab portion;

wherein said second side edge tab has a second upper side edge tab portion and a second lower side edge tab portion; and folding said first upper side edge tab portion and said second upper side edge tab portion so as to form said upper face;

folding said first lower side edge tab portion and said second lower side edge tab portion so as to form said lower face;

wherein said first side edge tab is contiguous with said second side edge tab so as to form said hinge face, said first upper side edge tab portion being contiguous with said first main section upper edge tab so as to form said upper face with a corresponding rounded folded edge on said hinge face, said second upper side edge tab portion being contiguous with said second main section upper edge tab so as to form said upper face with a corresponding rounded folded edge on said hinge face, said first lower side edge tab portion being contiguous with said first main section lower edge tab so as to form said lower face with a corresponding rounded folded edge on said hinge face, said second lower side edge tab portion being contiguous with said second main section lower edge tab so as to form said lower face with a corresponding rounded folded edge on said hinge face.

12. The method of forming a door, according to claim 11, wherein the panel is comprised of a composite material, said core being comprised of a plastic material, wherein the step of forming said first V-shaped groove comprises cutting into said inner sheet and partially into said core, and wherein the step of forming said second V-shaped groove comprises cutting into said inner sheet and partially into said core.

13. The method of forming a door, according to claim 11, further comprising the steps of:

inserting a frame between said inner sheet corresponding to said first main section and said inner sheet corresponding to said second main section.

14. The method of forming a door, according to claim 11, further comprising the steps of:

inserting an infill material between said inner sheet corresponding to said first main section and said inner sheet corresponding to said second main section as a liquid; and solidifying said infill material as a foam.

15. The method of forming a door, according to claim 11, further comprising the steps of:

mounting a hinge 90 having a door mount section, said door mount section being attached to said first side edge tab and said second side edge tab of said hinge face.

* * * * *